United States Patent [19]

Saint

[11] 4,165,872

[45] Aug. 28, 1979

[54] MOTOR OPERATED SWINGS

[75] Inventor: David Saint, Elverson, Pa.

[73] Assignee: Graco Metal Products, Inc., Elverson, Pa.

[21] Appl. No.: 850,075

[22] Filed: Nov. 10, 1977

[51] Int. Cl.[2] ..... A63G 9/16

[52] U.S. Cl. ..... 272/86; 185/38

[58] Field of Search ..... 272/86, 83 A; 287/110, 287/114, 115, 83; 267/118; 297/273, 274, 275, 276, 277, 278, 279, 280, 281, 282-291, 5, 8; 308/207 A, 207 R; 5/109; 58/114; 185/38, 37, 45; 46/29

[56] References Cited

U.S. PATENT DOCUMENTS

| | | | |
|---|---|---|---|
| 2,807,309 | 9/1957 | Saint et al. | 273/86 |
| 3,568,802 | 3/1971 | Marshall | 185/45 |
| 3,667,756 | 6/1972 | Barrett | 273/86 |

*Primary Examiner*—Richard C. Pinkham
*Assistant Examiner*—T. Brown
*Attorney, Agent, or Firm*—Zachary T. Wobensmith, 2nd; Zachary T. Wobensmith, III

[57] ABSTRACT

A motor operated swing or the like is disclosed which includes a canopy supported by legs which in turn has mounted therein a reciprocable closed carriage which supports a swing seat, cradle or the like and encloses the motor mechanism and the controls therefor. The canopy has outer enclosing end plates and inner end plates which are readily assembled to the canopy, with the inner end plates supporting a spring winding shaft with a spring tube thereon surrounded by the motor spring. A friction free escapement of synthetic plastic is provided which includes a toothed ratchet wheel, a gravity actuated safety pawl, a gravity actuated safety dog and a gravity actuated actuator for successively actuating said pawl and dog, the motor spring being connected at one end to the carriage and at the other end to the ratchet wheel. The escapement has double safety provisions for the pawl and dog, is constructed so as to be readily assembled without extra parts, and has accessible provisions for unwinding, if desired.

19 Claims, 12 Drawing Figures

MOTOR OPERATED SWINGS

BACKGROUND OF THE INVENTION

1. Field of the Invention

This invention relates to motor operated swings and the like.

2. Discussion of the Prior Art

It has heretofore been proposed as shown in the U.S. Pat. No. 2,807,309 to Saint et. al., to provide a spring motor operated swing which included an escapement with a spring controlled dog and a spring controlled pawl.

In my prior U.S. Pat. No. 3,804,477, a motor driven cradle or the like is disclosed with a spring for operation for an extended time, the escapement having a single spring directly controlling both the dog and the pawl.

In the U.S. Pat. No. 2,557,907, to Cranfill, Jr., et al., a nursery cradle is provided in which a shift plate, ratchet wheel and ratchet wheel controlling lugs are used but the shift plate is spring urged, alternate cam operation is shown, the operating parts are not made of friction free materials, the lugs are mounted in an entirely different and less advantageous manner and the construction and assembly would be quite costly.

De Pasqua, in U.S. Pat. No. 2,860,727, shows a mechanically agitated cradle which is similar to and has the same disadvantages as the Cranfill Jr. et al. U.S. Pat. No. 2,557,907.

Di Pasqua, in U.S. Pat. No. 3,073,416, shows a spring motor for swings in which a canopy is provided, open and unprotected at the bottom so that easy access is available to the interior and to the motor and escapement mechanism and which is hazardous to the user. Springs are also employed to accomplish the escapement.

In these and other spring motor operated swings the parts are relatively difficult to assemble, are made of metal with contacting frictional wearing surfaces, have springs for actuating the components of the escapement, do not make any provisions for inspection of the escapement components and have other shortcomings.

SUMMARY OF THE INVENTION

In accordance with the invention a spring motor operated swing or the like is provided which includes a motor enclosing leg supported canopy with a reciprocable closed carriage on which the swing seat or cradle is supported, the canopy preferably having outer enclosing end plates and inner end plates both of which are readily assembled to the canopy with the inner end plates supporting a spring winding shaft in a flanged shouldered support. The shaft has a spring tube thereon surrounded by the motor spring, the spring, tube and shaft being enclosed within the carriage and canopy to prevent easy access to the interior and reduce hazards to the user. A friction free escapement of synthetic plastic is provided, enclosed within the carriage which includes a rotatable ratchet gear, a gravity actuated pivotally mounted safety pawl, a gravity actuated pivotally mounted safety dog and a gravity actuated pivotally mounted actuator for successively actuating the pawl and dog and eliminating the necessity for springs to position the dog and pawl. The motor spring is connected at one end to the carriage and at the other end to the ratchet gear. The escapement is constructed so as to be readily assembled, is capable of inspection for trouble shooting and has accessible provisions for unwinding.

It is the principal object of the invention to provide a motor operated swing having improved and simplified details of construction contributing to ease of assembly, good manufacturing control, economy in production, and long life.

It is a further object of the invention to provide a motor operated swing and the like with an improved mounting of the winding shaft and actuating spring.

It is a further object of the invention to provide a motor operated swing and the like having a simple but effective escapement including a friction free pawl, dog and actuator for the pawl and dog.

It is a further object of the invention to provide a motor operated swing and the like having an improved canopy assembly which can be readily assembled without the necessity for riveting or welding.

It is a further object of the invention to provide a motor operated swing and the like in which the motor spring is mounted in a simple but effective manner.

It is a further object of the invention to provide a motor operated swing and the like in which the operating spring is relatively inaccessible by reason of its enclosure within the canopy and the carriage which carries the swing or the like.

It is a further object of the invention to provide a motor operated swing and the like with provisions for unwinding the motor spring for maintenance and repair.

Other objects and advantageous features of the invention will be apparent from the description and claims.

BRIEF DESCRIPTION OF THE DRAWINGS

The nature and characteristic features of the invention will be more readily understood from the following description taken in connection with the accompanying drawings forming part hereof in which.

Figure 1:
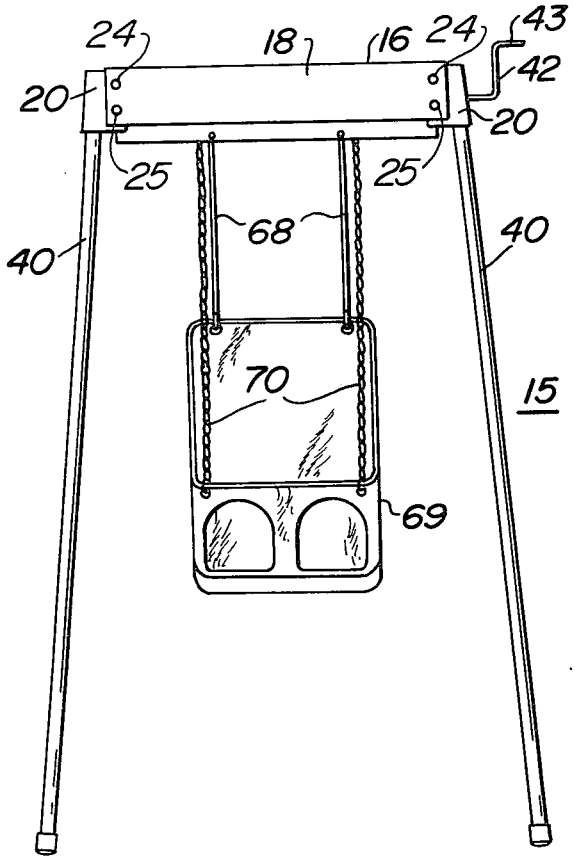
FIG. 1 is a front elevation view of the motor operated swing in accordance with the invention.
Figure 2:
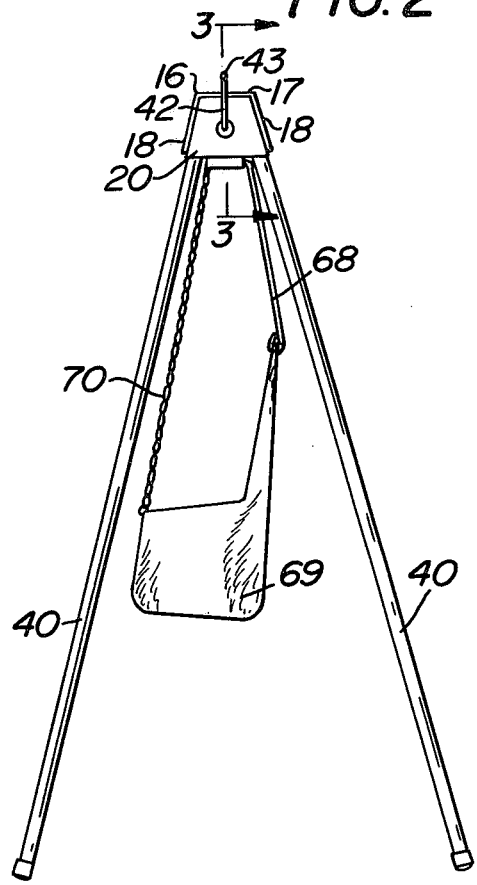
FIG. 2 is a side elevation view of the motor operated swing shown in FIG. 1.

It should, of course, be understood that the description and drawings herein are illustrative merely and that various modifications and changes can be made in the structure disclosed without departing from the spirit of the invention.

Like numerals refer to like parts throughout the several views.

DESCRIPTION OF THE PREFERRED EMBODIMENT

Referring now more particularly to the drawings, a swing in accordance with the invention is shown generally at 15 and includes a canopy 16, preferably formed of sheet metal, and having a horizontal top wall 7 and integral inclined front and rear walls 18. End closure caps or outer end plates 20 are provided which include an outer inclined end wall 21, a top flange 22 for reception within the top wall 17 of the canopy 16 and side flanges 23 for reception within the front and rear walls 18 of the canopy 16. The front and rear walls 18 at each end are provided with upper and lower struck in cylindrical projections 24 and 25. The side flanges 23 of the end caps 20 each has an upper slot 28 extending from its top margin for engagement with the upper projection 24. Each side flange 23 also has a lower opening 29 for engagement with the lower projection 25 and a spring tongue 30 to facilitate insertion and retention at the lower projection 25.

Inner end plates 32 and 33 are provided each having a side flange 34 at the front and rear. Each of the side flanges 34 like the side flanges 23, has an upper opening 28 for engagement with the upper projection 24 and a lower opening 29 with a spring tongue 30 for engagement with the lower projection 25. The end plates 32 and 33 each has inner transverse end walls 35 with struck out keyhole portions 36 with flanged curved shoulders 36' which provide for the insertion and support of a spring winding shaft 37 free from abrasion of the shaft 37 in use.

Each of the inner end walls 35 also has upper and lower leg engaging portions 39 for retaining inclined supporting legs 40 between the leg engaging portions 39 and the interiors of the end walls 21.

The winding shaft 37 is preferably provided at its outer end with an exteriorly accessible crank arm 42 with a crank handle 43 on the outer end for winding. The inner end of the shaft 37 inwardly of the support at 36 in the inner end plate 33 and contiguous to the inner end plate 32 has struck out tongues 45 (see FIG. 10) for engagement within the interior of a hub portion 46 of the ratchet wheel 48. The ratchet wheel 48 also has a hub portion 49 for the reception of a spring carrying power tube 50. The tube 50 is supported on the shaft 37 at the end contiguous to the crank arm 42 by a supporting bushing 52 and a key hole portion **36*a* in one end wall 51 of the carriage 55. The other end wall 53 of the carriage 55 has a struck in portion 54 which extends into the hub 46**.

A motor spring 56 is provided having a plurality of turns with the turns 57 at the end of the spring 56 contiguous to the crank handle 43 of reduced diameter and for friction gripping engagement with the tube 50 and having an end 58 extending downwardly and past an inbent arm 59 and then upwardly in engagement with a struck-in leg 60 on the end wall 51 of the carriage 55.

The carriage 55 has a bottom wall 62, upwardly extending parallel side wall sections 63 with inclined side wall sections 64 thereabove, with flared upwardly extending side wall sections 65 and inbent upper ribs 66 for stiffening. The shape and disposition of the carriage 55 serves as a guard to prevent access of fingers to locations where they could be pinched or injured.

The side wall sections 63 have rigid seat actuating pusher arms 68 extending therethrough and which extend downwardly in supporting engagement with the rear of a seat 69, and chains 70 connected thereto and extending in supporting relation to a forward extension of the seat 69. A cradle (not shown) could be employed in place of the seat 69 as is well known in the art.

Figure 10:
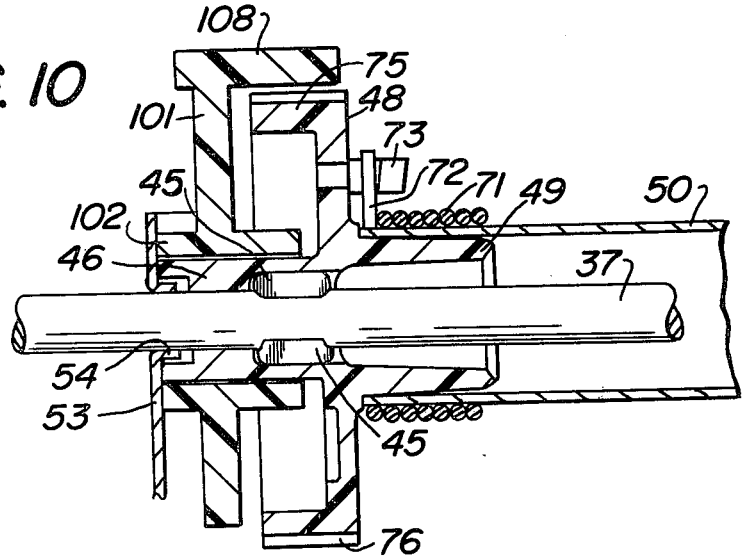
FIG. 10 is a fragmentary transverse vertical sectional view, taken approximately on the line 10—10 of FIG. 6 and showing the interrelationship of the winding shaft, the spring carrying tube, the spring, the ratchet wheel, the actuator and an end wall of the carriage.
Figure 3:
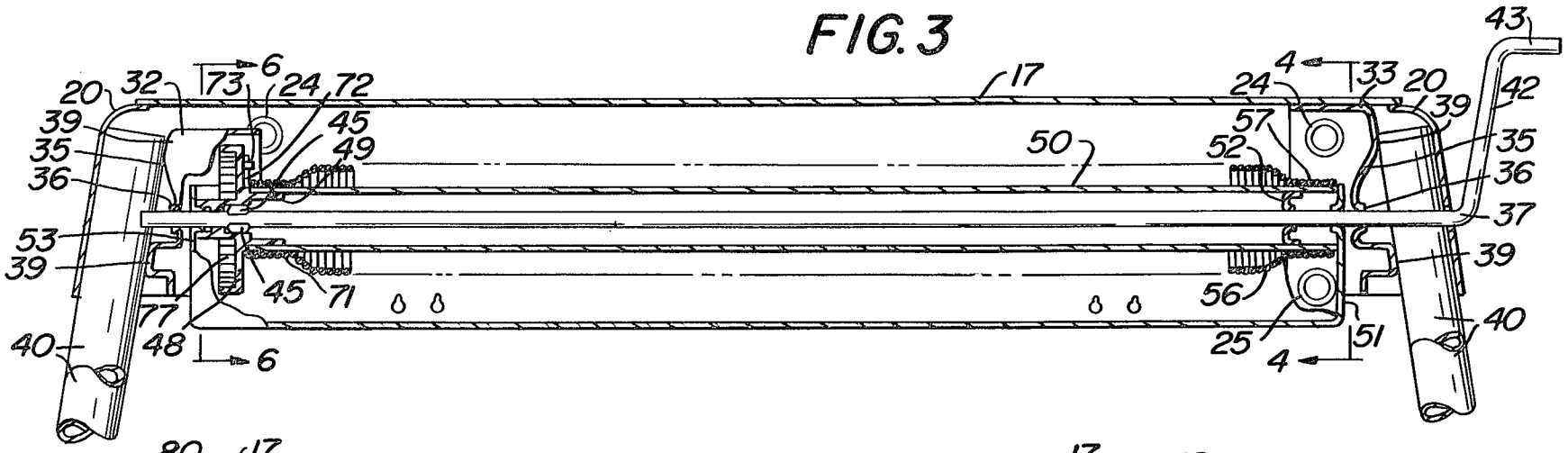
FIG. 3 is a vertical sectional view, enlarged, taken approximately on the line 3—3 of FIG. 2.
Figure 5:
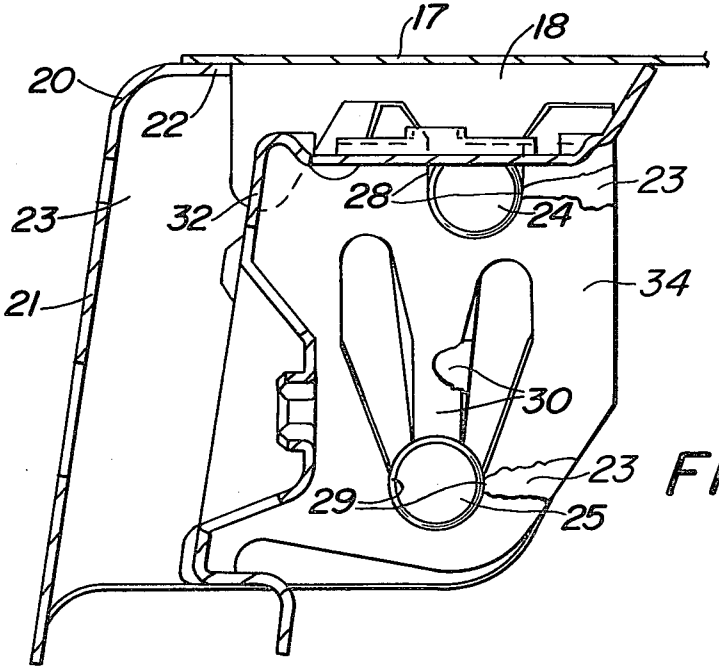
FIG. 5 is a fragmentary longitudinal sectional view taken approximately on the line 5—5 of FIG. 4.
Figure 4:
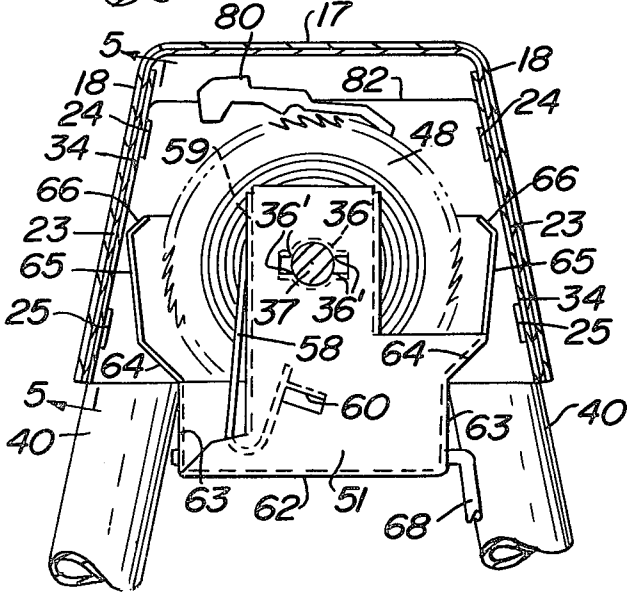
FIG. 4 is a transverse vertical sectional view, still further enlarged, taken approximately on the line 4—4 of FIG. 3.

The motor spring 56, as shown in FIG. 10, has an end portion 71 of reduced diameter in engagement with the spring tube 50 from which an end 72 extends in engagement with a lug 73 on the ratchet wheel 48 for applying a rotational force thereto.

The ratchet wheel 48 has a circumferential rim 75 with teeth 76 on the exterior of the rim 75 and teeth 77 on the interior of the rim 75.

Figure 11:
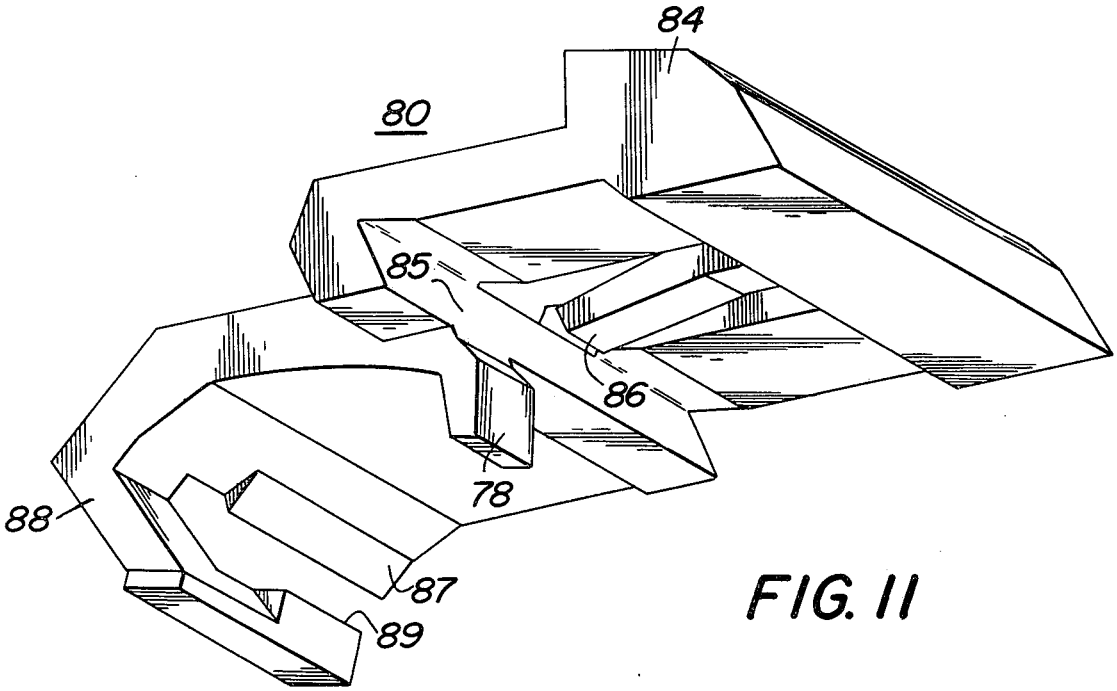
FIG. 11 is a perspective view of the pawl.

A pawl 80 is provided, preferably of synthetic plastic material, shown in detail in FIG. 11, and which is insertable through and extends through an opening 81 in the horizontal top wall 82 of the inner end plate 32. The wall 82 has an inclined portion 83 at one edge of the opening 81 which serves as pivot or fulcrum for the pawl 80. The pawl 80 has a head 84 which tends to urge it in a clockwise direction, displacement of the pawl 80 being prevent by retainer fingers 85 and 86.

The pawl 80 has a control or actuating finger 78 for purposes to be explained.

The pawl 80 has a pawl bill 87 for engagement in timed relation with one of the outer teeth 76 and an arm 88 with an end portion 89 of rectangular cross section which is effective to swing the pawl bill 87 into holding engagement with one of the outer teeth 76 upon rapid rotation of the ratchet wheel 48.

Figure 12:
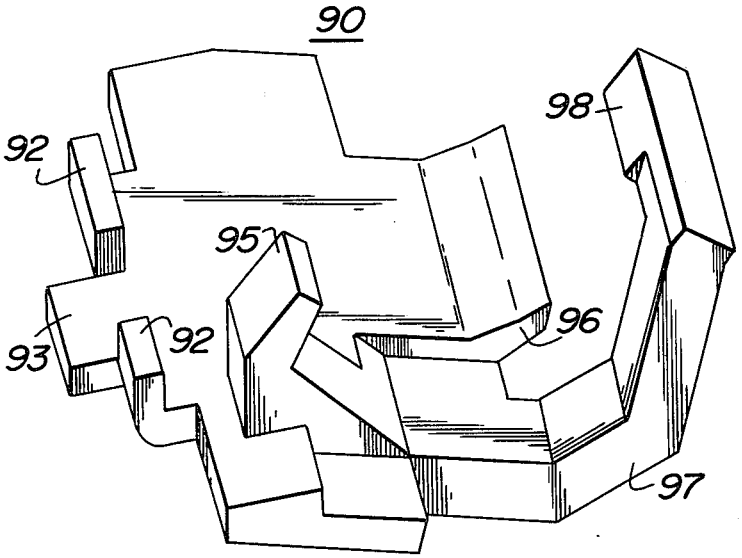
FIG. 12 is a perspective view of the dog.

A dog 90 is provided, preferably of synthetic plastic material, shown in detail in FIG. 12, and which is carried in a slot 91 in a side wall 63 (see FIGS. 6, 7, 8 and 9). The dog 90 has spaced upstanding lugs 92 which prevent displacement of the dog 90 to the right while permitting pivotal movement at the slot 91. An actuating finger 93 is available to release the dog 90 from engagement to permit unwinding of the motor spring 56 if desired.

The dog 90 has an actuating finger 95 for purposes to be explained and a dog bill 96 for engagement with one of the outer teeth 76, and an arm 97 with an end portion 98 of rectangular cross section effective to swing the dog bill 96 into holding engagement with one of the outer teeth 76 upon rapid rotation of the ratchet wheel 48.

Figure 6:
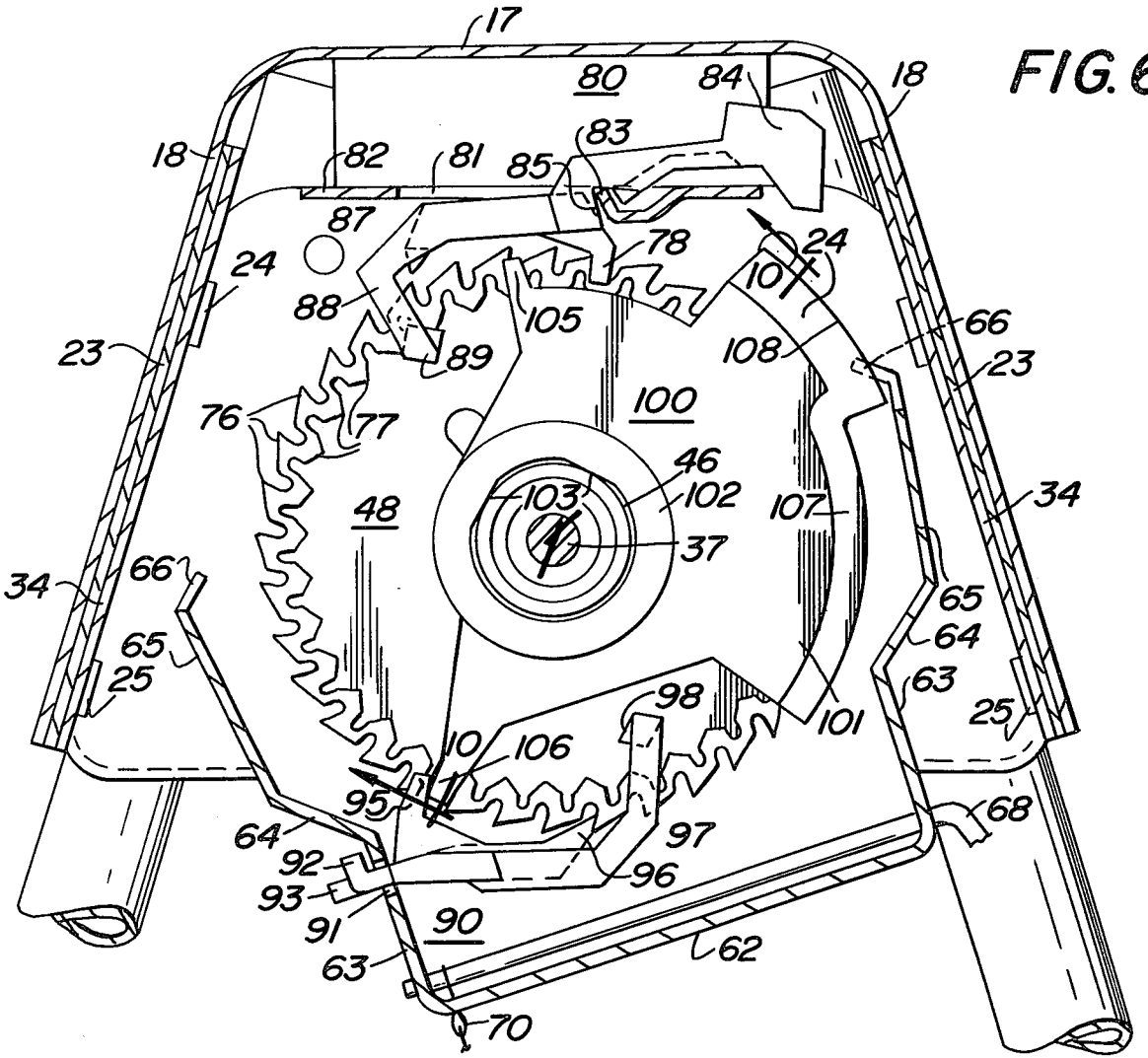
FIG. 6 is a vertical transverse sectional view, enlarged, taken approximately on the line 6—6 of FIG. 3 and showing one of the operating conditions of the carriage, dog, pawl and actuator.

It will be noted that the major portion of the dog 90 is to the right of its pivot as seen in FIG. 6 so that the weight of the dog 90 tends to move it in a clockwise direction.

An actuator 100 is provided preferably of synthetic plastic having a plate portion 101 and a hub 102 with spaced inclined interior faces 103 for free bearing engagement on the exterior of the hub 49.

The actuator 100 has an actuating arm 105 for engagement with the control finger 78 of the pawl 80 and an actuating arm 106 for engagement with the actuating finger 95.

The actuator 100 has an arcuate rim portion 107 facing away from the rim 75 and an arcuate rim portion 108 of greater diameter extending over the rim 75 and spaced outwardly therefrom.

It will be noted that a substantial portion of the mass of the actuator 100, including the plate portion 101 is to the right of the shaft 37 and tends to urge the actuator 100 clockwise.

The mode of operation will now be pointed out.

The handle 43 is rotated to wind the motor spring 56 to impart through the spring end 72 and lug 73 in a clockwise force to the ratchet wheel 48.

If now the carriage 55 is moved to start the motion, or if the spring force of the motor spring 56 should start the motion, the pawl bill 87 of the pawl 80 and the dog bill 96 of the dog 90 successively engage and disengage with the teeth 76 of the ratchet wheel 48. This is effected under the control of the actuator 100 acting upon the gravity urged pawl 80 and dog 90.

The actuating arm 105, upon engagement with the control finger 78 of the pawl 80, and against gravity action on the pawl 80 urges the pawl bill 87 into engagement with a tooth 76 of the ratchet wheel 48.

The actuating arm 106, upon engagement with the actuating finger 95 of the dog 90, and against the gravity action on the dog 90, urges the dog bill 96 into engagement with a tooth 76 of the ratchet wheel 48.

The action of the pawl 80, the dog 90 and the actuator 100 in their relation to the oscillating movement of the carriage 55 is shown for a number of different operating conditions in FIGS. 6, 7, 8 and 9.

Referring first to FIG. 6, the carriage 55 is shown at the end of its counterclockwise movement with the dog bill 96 engaged with one of the teeth 76 and held by the engagement of the actuating arm 106 with the finger 95. It will be noted that the pawl bill 87 is held out of engagement with the teeth 76 of the ratchet wheel 76 by the positioning of the pawl 80 by the head 84.

Figure 7:
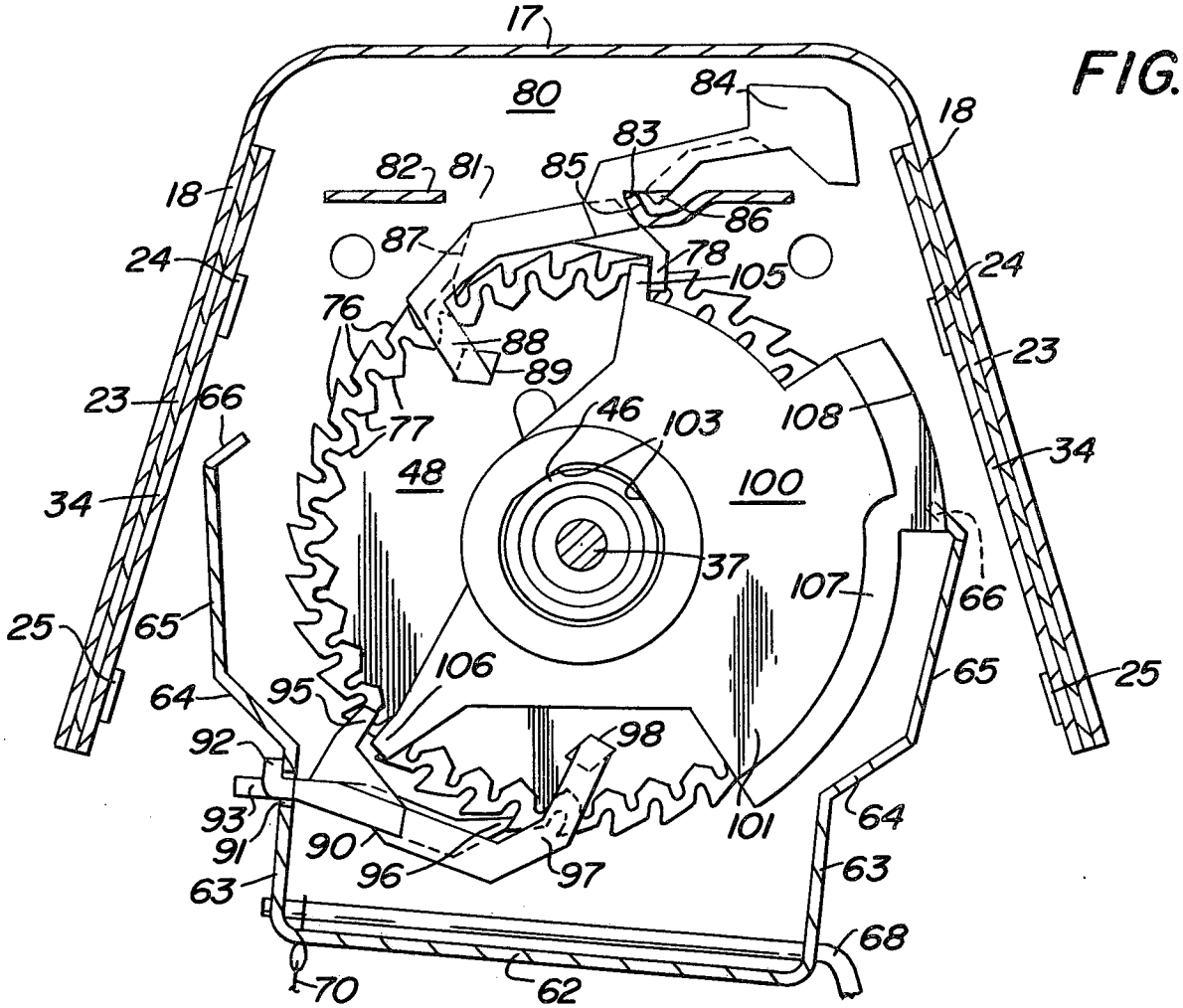
FIG. 7 is a view similar to FIG. 6 showing another operating position of the carriage, dog, pawl and actuator.

In FIG. 7, the carriage 55 is shown in a partially completed clockwise return swing with the actuating arm 106 having just disengaged actuating finger 95 permitting the dog 90 to swing clockwise to disengage the dog bill 96 after a slight further movement of the carriage 55. The actuating arm 105, immediately prior to release of the dog 90, has engaged the control finger 80 and moved the pawl bill 87 into engagement with a tooth 76 counterclockwise beyond the tooth 76 with which it was previously engaged.

Figure 8:
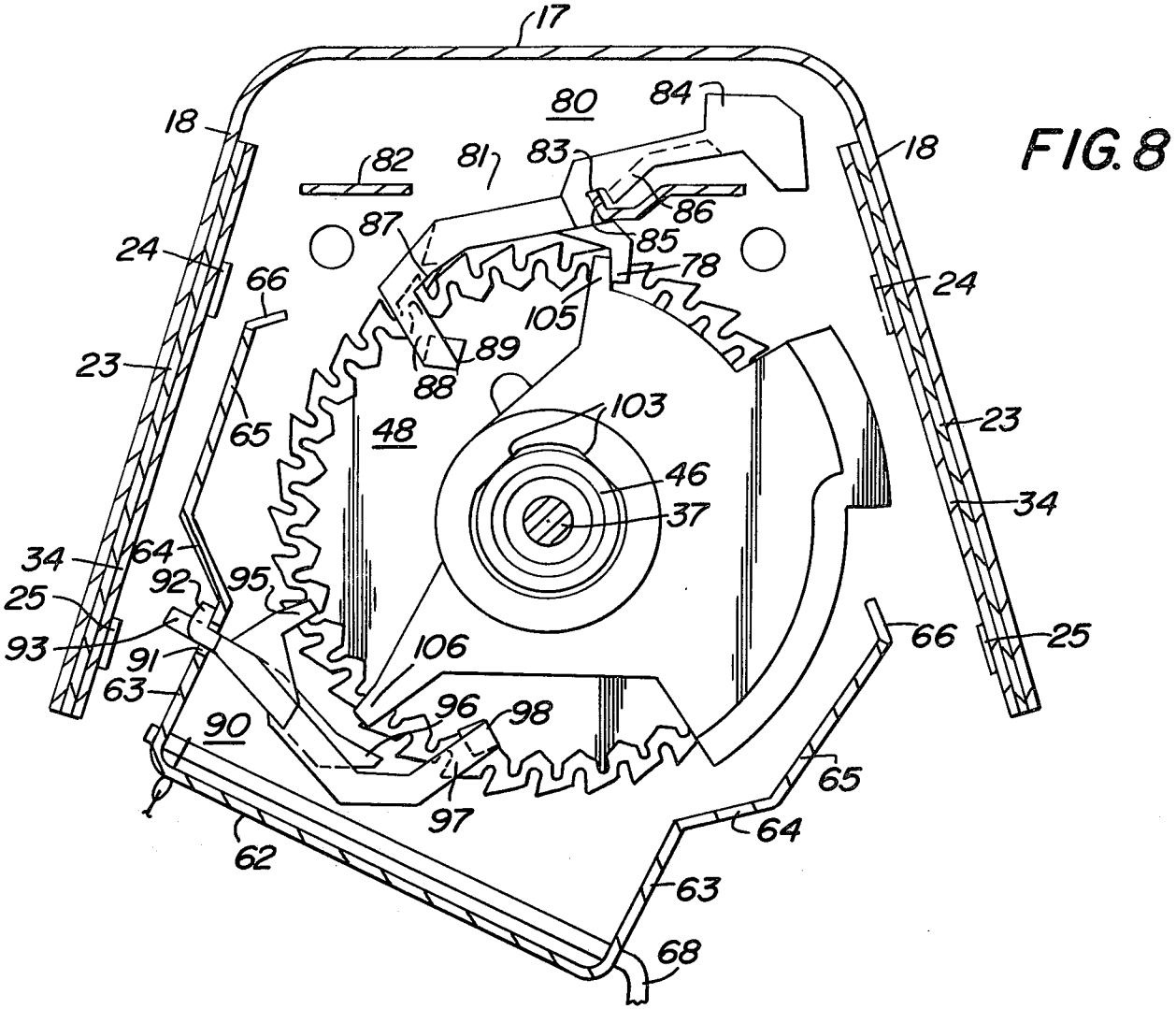
FIG. 8 is a view similar to FIG. 6 showing another operating position of the carriage, dog, pawl and actuator.

In FIG. 8, the carriage 55 is shown at the end of its clockwise movement with pawl bill 87 in engagement with a tooth 76 and held by the engagement of the actuating arm 105 with the control finger 78. The finger 95 by its separation from the actuating arm 106 has permitted the dog 90 to drop and move the dog bill 96 out of engagement.

Figure 9:
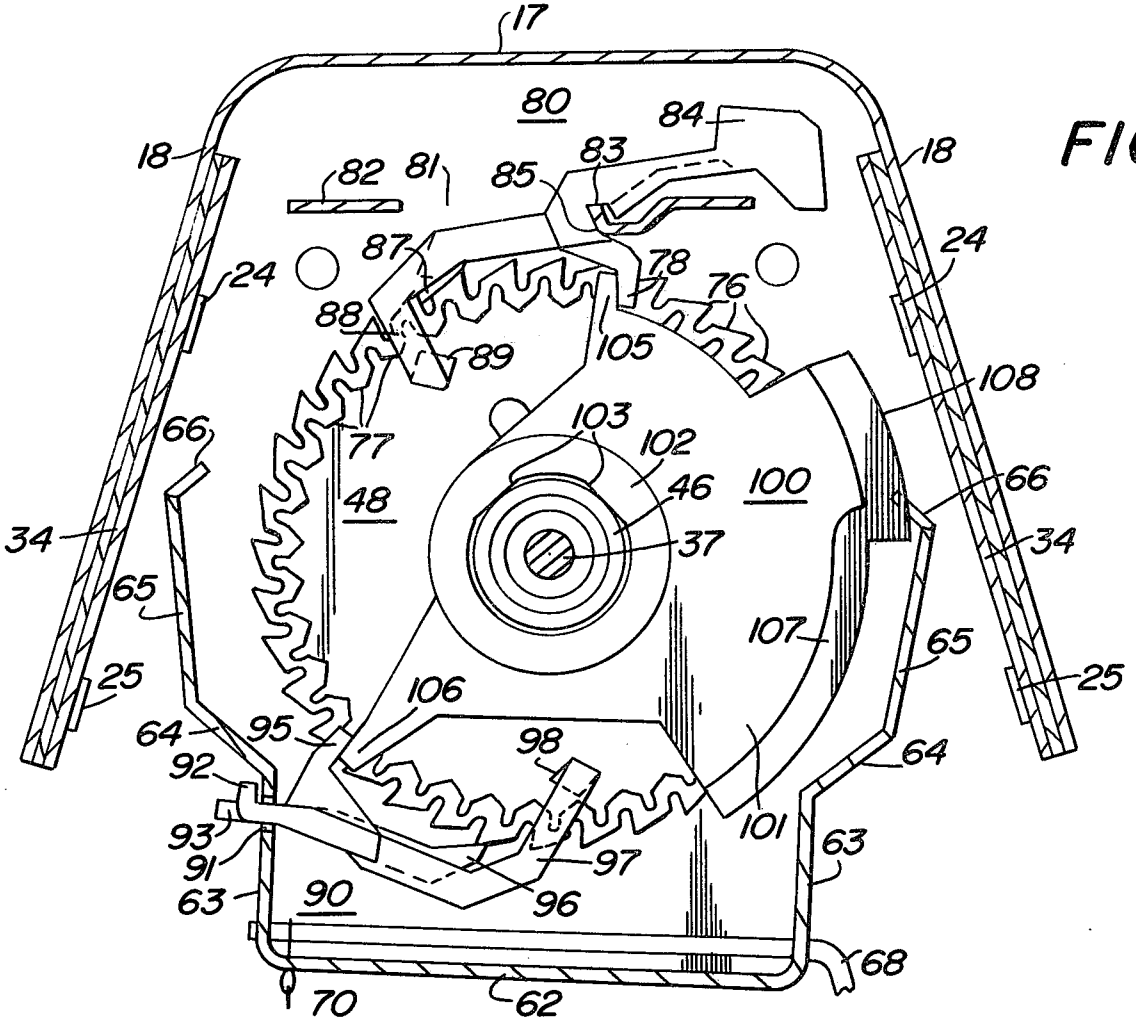
FIG. 9 is a view similar to FIG. 6 showing another operating position of the carriage, dog, pawl and actuator.

In FIG. 9, the carriage 55 is shown close to the bottom of its counterclockwise swing with the finger 95 just engaged with the arm 106 and the dog bill 96 is being urged toward tooth engagement since the arm 105 is about to disengage the finger 78 to disengage the pawl bill 87 and retract the same.

In the event that the pawl bill 87 of the pawl 80 and the dog bill 96 of the dog 90 are both disengaged any tendency of the ratchet 76 to rotate clockwise at excessive speed is overcome by the action of the teeth 77 on either the end portion 89 of the pawl 80 or the end portion 98 of the dog 90. The teeth 77, upon striking either the end portion 89 or the end portion 98 drive the pawl bill 87 or the dog bill 96 into tooth engaged position with respect to a tooth 76.

If at any time it is desired to unwind the motor spring 56, with the pawl bill 87 out of ratchet tooth engagement the actuating finger 93 is actuated to release the dog bill 96.

I claim:

1. A power operated swing or the like comprising
a canopy having side walls with ends,
outer end closure caps for said canopy,
inner end walls interiorly disposed in said canopy with respect to said end closure caps,
a shaft within said canopy,
driving means for said shaft,
a carriage pivotally mounted on said shaft within said canopy for oscillatory movement,
operating connections between said shaft and said carriage, and
members for mounting said end closure caps and said inner end walls comprising spaced inwardly extending projections on said canopy at each end,
said end closure caps and said inner end walls having portions for engagement on said projections,
at least one of said portions including a resilient tongue for engagement with one of said projections.

2. The combination defined in claim 1 in which
in each of said end closure caps one of said portions is a first opening and another of said portions is a second opening with a resilient projection engaging tongue terminating at said second opening.

3. The combination defined in claim 1 in which
in each of said inner end walls one of said portions is a first opening and another of said portions is a second opening with a resilient projection engaging tongue terminating at said second opening.

4. A power operated swing or the like comprising
a canopy,
end cap members for said canopy,
supporting legs for said canopy,
end frame plates in said canopy,
a shaft member extending within the canopy and supported by said plates,
a driving spring carried on said shaft member,
a reciprocable carriage on said shaft member and within said canopy and restricting access to the interior of the canopy, and
an escapement mechanism carried on said shaft member and one of said end frame plates and within said canopy and comprising a ratchet wheel and gravity responsive members controlling the ratchet wheel,
one of said gravity responsive members being pivotally mounted on said ratchet wheel,
another of said gravity responsive members being pivotally carried on one of said end plates, and
another of said gravity responsive members being pivotally carried on said carriage,
one end of said driving spring being connected to said carriage and the other end being connected to said ratchet wheel.

5. The combination defined in claim 4 in which
said ratchet wheel and said gravity responsive members are of synthetic plastic material.

6. The combination defined in claim 4 in which
one of said gravity responsive members comprise a ratchet wheel controlling pawl insertably mounted within said canopy.

7. The combination defined in claim 4 in which
one of said gravity responsive members comprises a ratchet wheel controlling dog mounted in said carriage.

8. The combination defined in claim 4 in which one end of said driving spring is in engagement with a projecting portion of said ratchet wheel.

9. The combination defined in claim 4 in which said ratchet wheel has an integral hub portion, and said one of said gravity responsive members is mounted on said hub portion.

10. A power operated swing or the like comprising
a canopy,
end cap members for said canopy,
supporting legs for said canopy,
end frame plates in said canopy,
a shaft member extending within the canopy and supported by said plates,
a driving spring carried on said shaft member,
a reciprocable carriage on said shaft member and within said canopy and restricting access to the interior of the cavity, and
an escapement mechanism carried on said shaft member and on one of said end frame plates and within said canopy and comprising a ratchet wheel and gravity responsive members controlling the ratchet wheel,
said gravity responsive members comprising
a pawl mounted within said canopy and having a pawl bill for engagement with said ratchet wheel and being normally urged by gravity to position said pawl bill out of engagement with the ratchet wheel,
a dog carried by said carriage and having a dog bill for engagement with said ratchet wheel and being normally urged by gravity to position its dog bill out of engagement with the ratchet wheel, and
an actuator member coaxial with said shaft member and having actuating arms for successively actuating said pawl and said dog,
one end of said spring being connected to said carriage and the other end being connected to said ratchet wheel.

11. The combination defined in claim 10 in which said actuator member successively moves ratchet wheel engaging bill portions of said pawl and said dog into ratchet wheel engagement.

12. The combination defined in claim 10 in which said actuator member is urged by gravity for successive engagement of said actuating arms with portions of said pawl and said dog.

13. The combination defined in claim 10 in which said ratchet wheel has a hub portion on which said actuator member is supported, and
said actuator member has inclined surfaces in engagement with said hub portion.

14. The combination defined in claim 10 in which said dog has an actuating finger for manual release of its engagement with the ratchet wheel.

15. The combination defined in claim 10 in which said end frame plates have portions for mounting said shaft member, and
said pawl is insertably carried on another portion of one of said end frame plates.

16. The combination defined in claim 10 in which said end frame plates have portions for mounting said shaft member, and
one of said end frame plates has another portion providing a pivot for said pawl.

17. The combination defined in claim 16 in which said pawl is insertably mounted on said other portion of said one end frame plate.

18. The combination defined in claim 10 in which said shaft member includes
a shaft,
a shaft tube within which said shaft is inserted, and
said ratchet wheel has a hub extending into said shaft tube, and
said shaft has a radial projection in keyed engagement in said hub.

19. The combination defined in claim 10 in which said shaft member includes
a shaft,
a shaft tube within which said shaft is inserted,
said shaft having an outstanding radial projection to provide a key, and
said shaft tube and said carriage have key hole portions for bearing engagement with said shaft through which said radial projection is insertable.

* * * * *